US006694561B1

(12) United States Patent
Harrison et al.

(10) Patent No.: US 6,694,561 B1
(45) Date of Patent: Feb. 24, 2004

(54) SWEEPING DEVICE

(76) Inventors: Bruce Harrison, 16 Tasman View, Wanganui (NZ); Gavin Kerr Doyle, Simpson Road, Wanganui (NZ)

( * ) Notice: Subject to any disclaimer, the term of this patent is extended or adjusted under 35 U.S.C. 154(b) by 0 days.

(21) Appl. No.: 09/647,943

(22) PCT Filed: Apr. 6, 1999

(86) PCT No.: PCT/NZ99/00043

§ 371 (c)(1),
(2), (4) Date: Feb. 5, 2001

(87) PCT Pub. No.: WO99/51120

PCT Pub. Date: Oct. 14, 1999

(30) Foreign Application Priority Data

Apr. 6, 1998 (NZ) ..... 330133

(51) Int. Cl.[7] ..... A46B 17/00; A46B 17/08

(52) U.S. Cl. ..... 15/159.1; 15/246

(58) Field of Search ..... 15/105, 106, 159.1, 15/160, 246; 56/400.04, 400.14, 400.15, 400.17; 280/47.131, 47.17, 47.24

(56) References Cited

U.S. PATENT DOCUMENTS 4,516,393 A 5/1985 Lambert

FOREIGN PATENT DOCUMENTS

| | | |
|---|---|---|
| AU | 150651 | 2/1952 |
| GB | 2 020 546 | 11/1979 |

*Primary Examiner*—Terrence R. Till
(74) *Attorney, Agent, or Firm*—Timothy J Keefer; Wildman, Harrold, Allen & Dixon LLP

(57) ABSTRACT

A sweeping device (1) having an actuating means (6), including a surface contacting means (2), a handle (3) connected to the surface contacting means and a friction reducing means (4, 7), in which the friction reducing means is adapted to enable the lifting of the surface contacting means of the sweeping device from the surface being swept or scraped upon user actuation of the actuating means (6).

19 Claims, 8 Drawing Sheets

Figure 1:
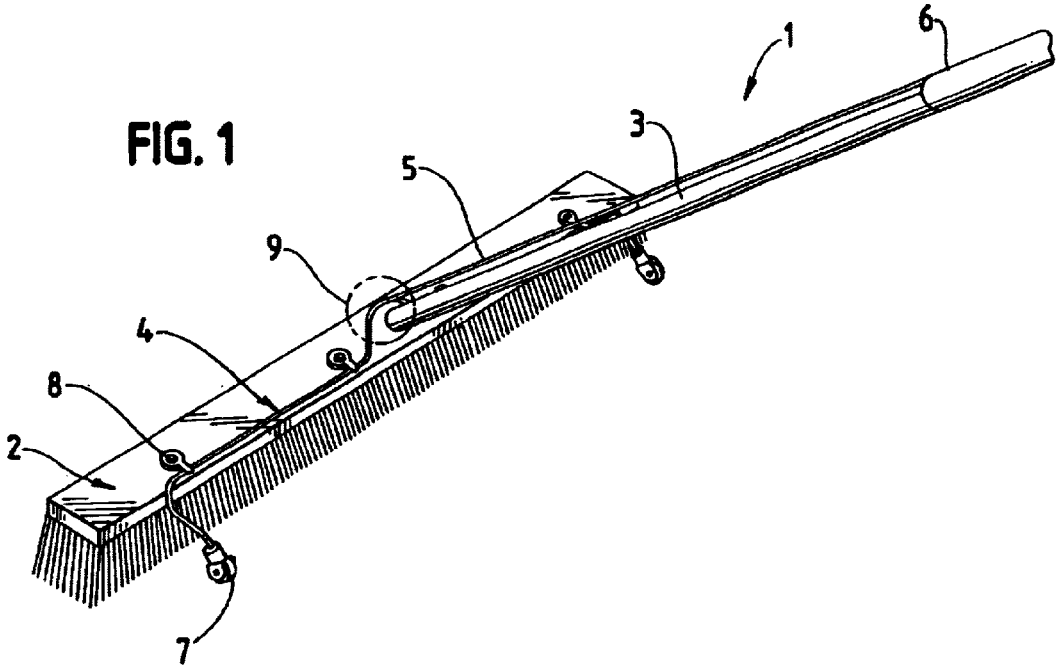

FIG. 11
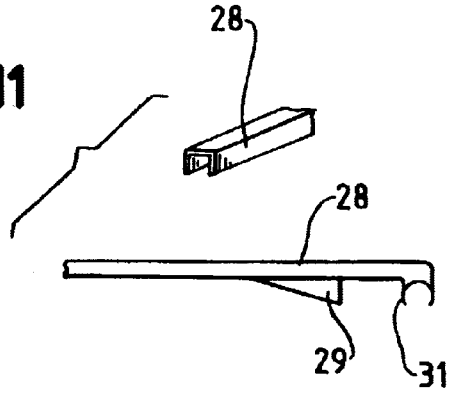
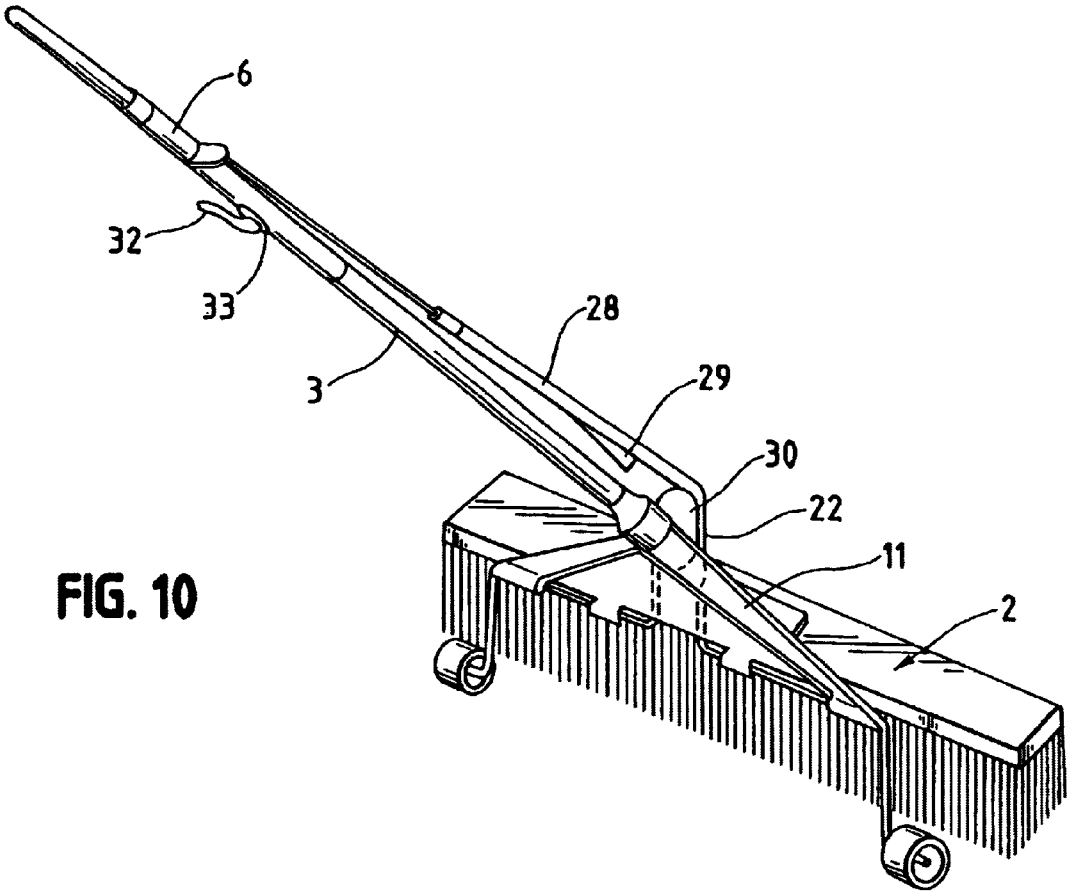
FIG. 10

SWEEPING DEVICE

CROSS REFERENCE TO RELATED APPLICATION

This application claims the priority of New Zealand patent application Serial No. NZ 330133 filed on Apr. 6, 1998.

TECHNICAL FIELD

This invention relates to a sweeping device and a method of sweeping, in particular a mechanism for a sweeping device which substantially reduces the effort of sweeping. The invention also relates to a support means for a sweeping device. In particular, although not exclusively, the present invention also relates to a support means that may be secured to the shaft of a broom or a broom stock to enable the broom head to be supported when the broom head is moved.

BACKGROUND ART

Known sweeping devices consist of a surface contacting head and a handle extending from the surface contacting head. When in use the surface contacting head is pushed back and forward by way of forces transmitted through the handle. In the operation of a sweeping device which has a wide surface contacting head a lot of effort must be exerted so as to push the surface contacting head across the surface in reverse and forward strokes. It is also difficult to move the surface contacting head in a sideways direction.

It is an object of the invention to provide a sweeping device that significantly reduces the effort needed to use a sweeping device, thereby eliminating back and arm strain and to provide a method of sweeping which overcomes these disadvantages or to at least provide the public with a useful choice.

DISCLOSURE OF THE INVENTION

According to one aspect of the present invention there is provided a sweeping device having an actuating means, the sweeping device comprising a surface contacting means, a handle connected to the surface contacting means and a friction reducing means, in which the friction reducing means is adapted to enable the lifting of the surface contacting means of the sweeping device from the surface being swept or scraped upon, user actuation of the actuating means, in which the actuating means is a sleeve located on the handle of the sweeping device.

Preferably, the friction reducing means of the sweeping device is adapted to substantially reduce the effort of a forward and/or reverse and/or a sideways stroke of the sweeping device.

Preferably, the friction reducing means of the sweeping device is connected to the surface contacting means of the sweeping device.

Preferably, the friction reducing means are wheels provided on arms extending from the surface contacting means.

Preferably, the actuating means, further includes a lock means to optionally lock the actuating means on the handle of the sweeping device.

According to a second aspect of the invention there is provided a sweeping device having an actuating means and a surface containing means including a support means comprising a body portion securable to a sweeping device handle or a broom stock and friction reducing means extending from the body portion which, when the support means is secured to a sweeping device, can selectively be brought into contact with a surface to at least partially support the head of a sweeping device, in which the actuating means is a sleeve located on the handle of the sweeping device.

Preferably the support means includes actuating means which adjusts the position of the friction reducing means when actuated to facilitate support of the sweeping device by the friction reducing means. The friction reducing means are preferably wheels provided on arms extending from either side of the body portion.

The body portion is preferably secured to a handle of the sweeping device by a fastening means which allows securement of the body portion at a selected location along a shaft of the sweeping device. Preferably the arrangement includes a threaded sleeve which may be screwed on to part of the body to cause portions of the body to be forced towards a shaft of a sweeping device to retain the body portion onto the handle of the sweeping device.

The friction reducing means preferably includes a shaft having arms extending from either end to wheels. The shaft may be pivoted by the actuating means to rotate the wheels downwardly towards the contacting means of the sweeping device or upwardly away from the contacting means of the sweeping device. The actuating means is preferably a sleeve linked to the shaft by an adjustable linkage.

In another aspect of the present invention there is provided a kit, adapted to enable the modification of a traditional sweeping device to incorporate a friction reducing means, the kit comprising a friction reducing means adapted for fixation to a sweeping device, and an actuating means to enable the lifting of the surface contacting means of the sweeping device from the surface being swept or scraped.

In a further aspect of the present invention there is provided a method of substantially reducing the effort involved in employing a sweeping device as hereinbefore described, the method comprising employing the friction reducing means when making a forward and/or reverse and/or a sideways stroke of the sweeping device, including a step in which the friction reducing means is actuated into position by the actuating means.

Further aspects of this invention which should be considered in all its novel aspects will become apparent by the following description given by way of example and with reference to the accompanying drawings, in which:

FIG. 1: Shows a perspective view of a sweeping device according to one embodiment.

Figure 2:
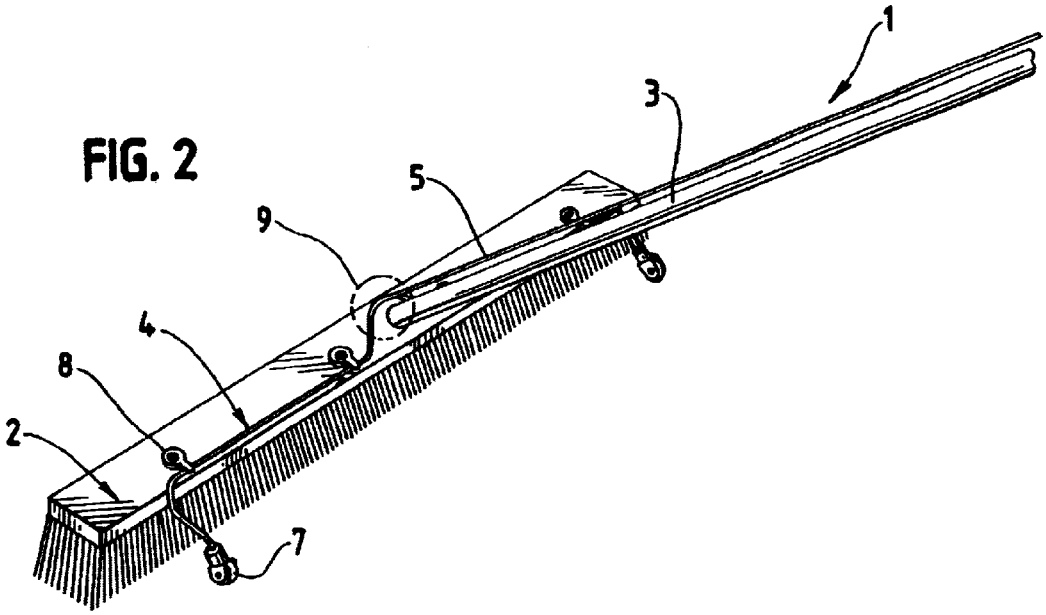

FIG. 2: Shows the sweeping device shown is FIG. 1 when the friction reducing means is moved to an in use position.

Figure 3:
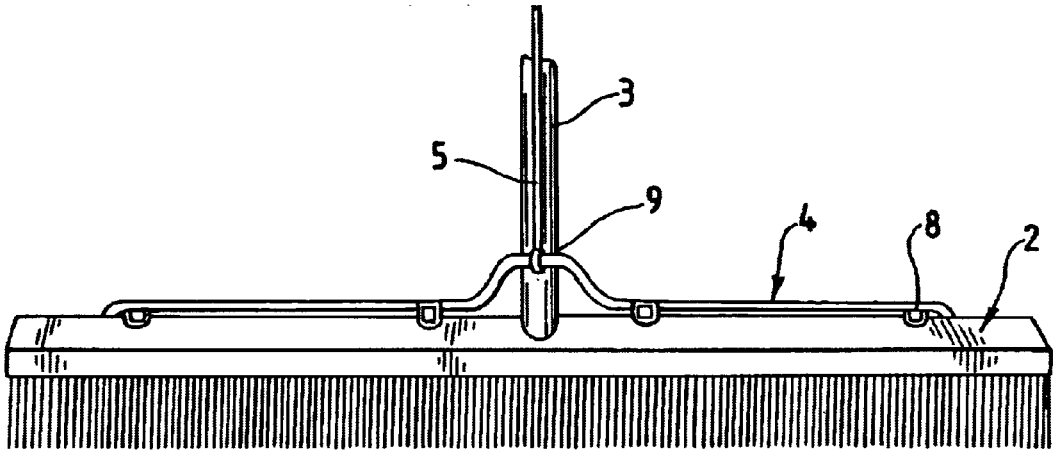

FIG. 3: Shows a front view of the sweeping device shown in FIGS. 1 and 2.

Figure 4:
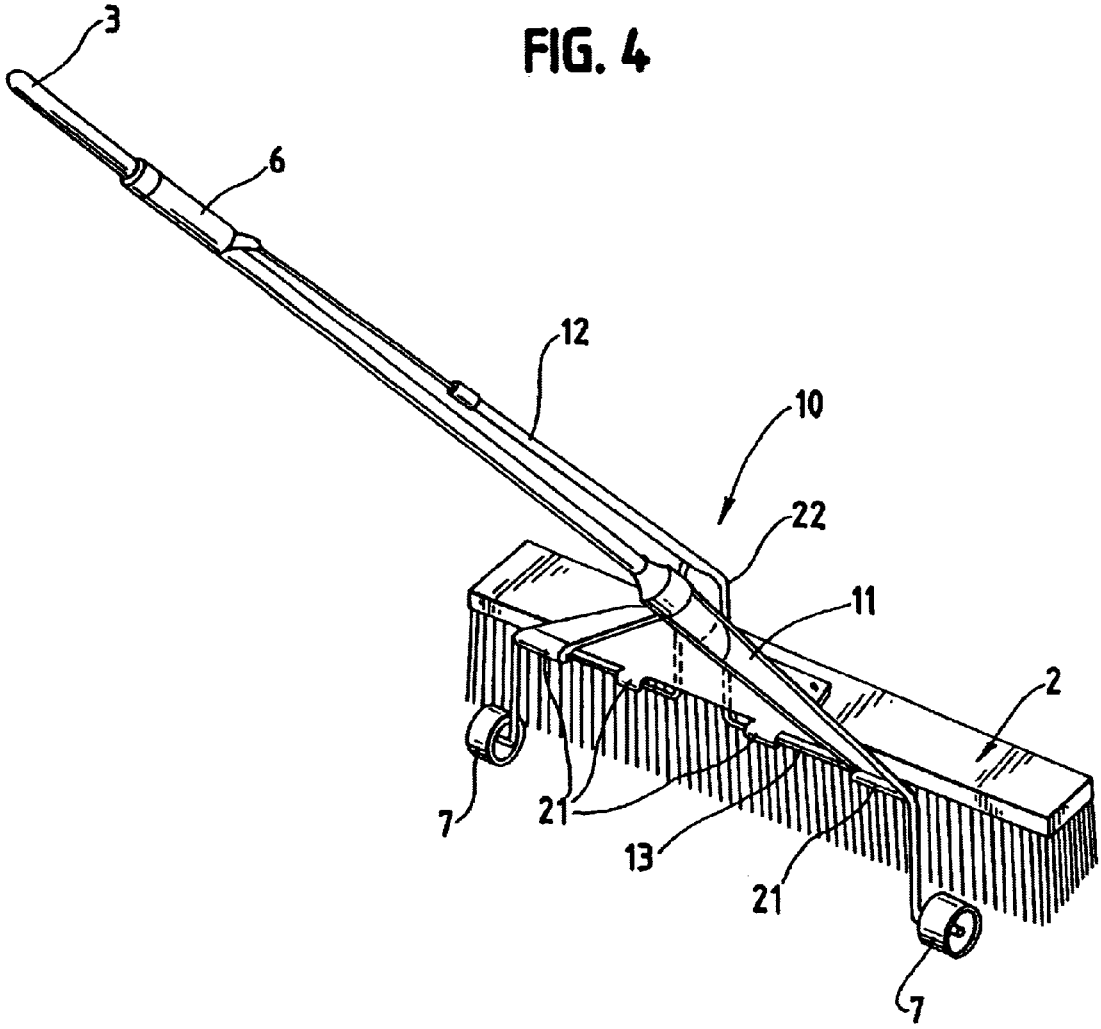

FIG. 4: Shows a perspective view of a support means when in use with a broom.

Figure 5:
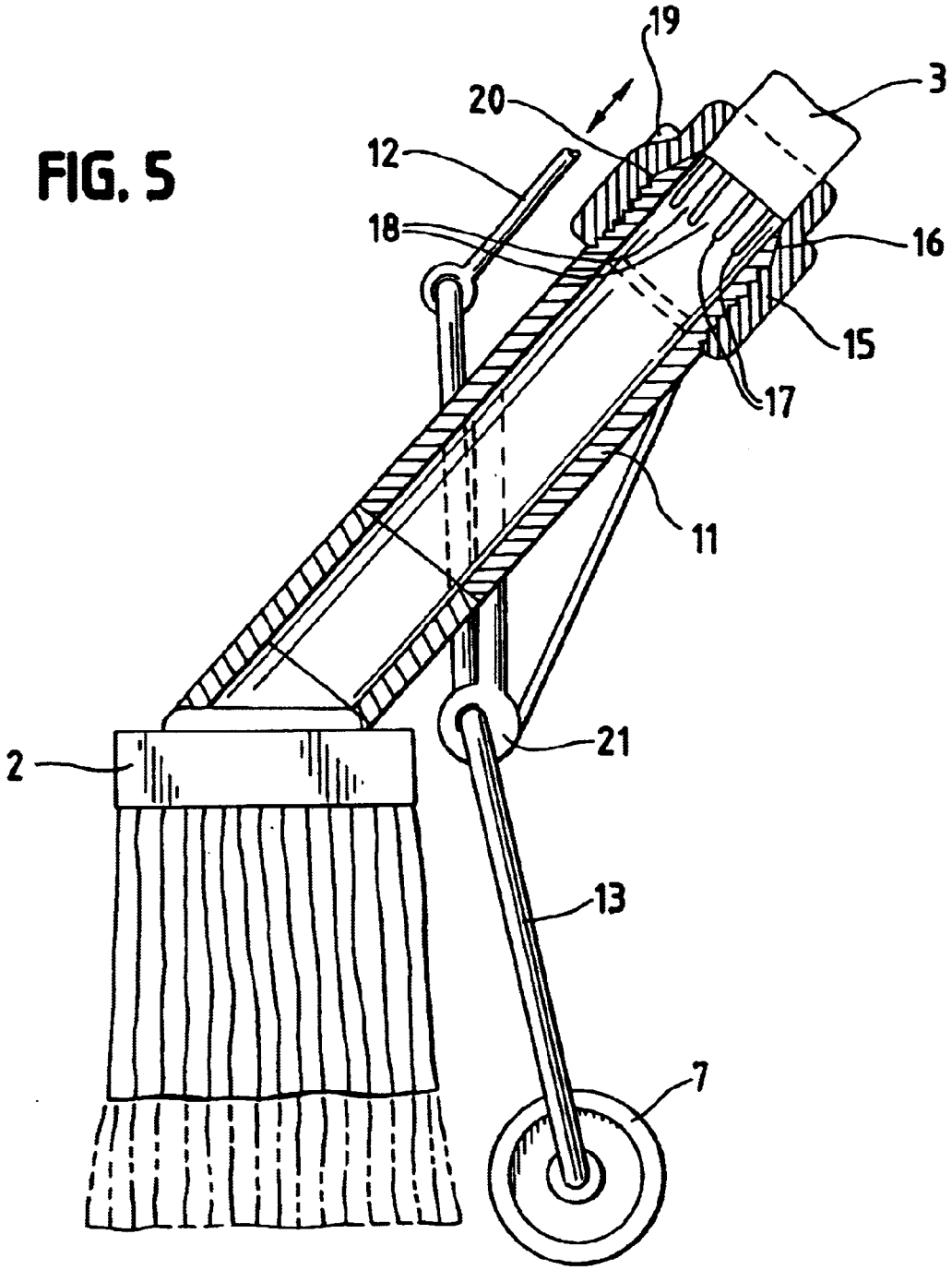

FIG. 5: Shows a partial cross-sectional side view of the support means when engaged with a broom.

Figure 6:
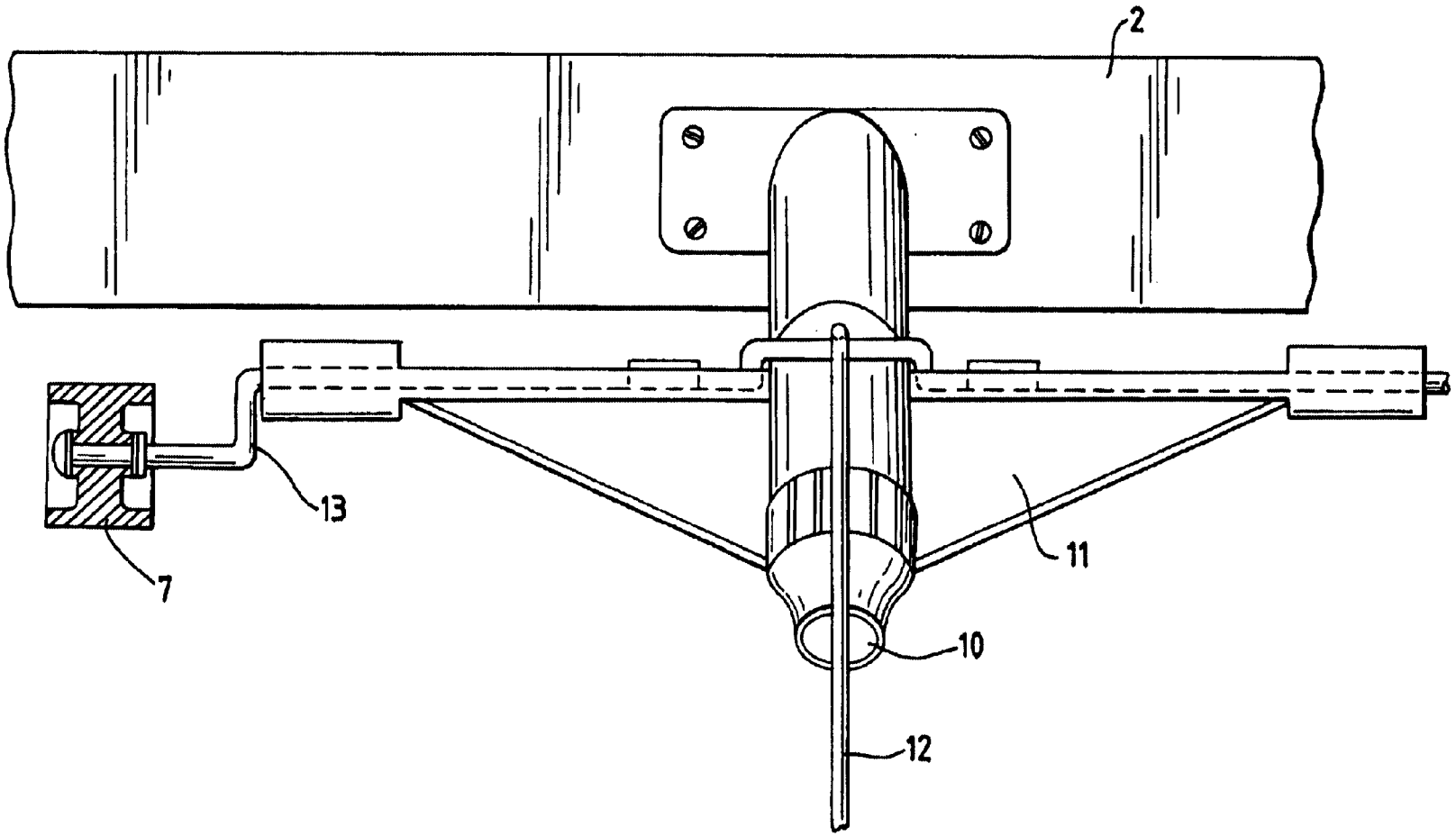

FIG. 6: Shows a top view of the support means when secured to a broom.

Figure 7:
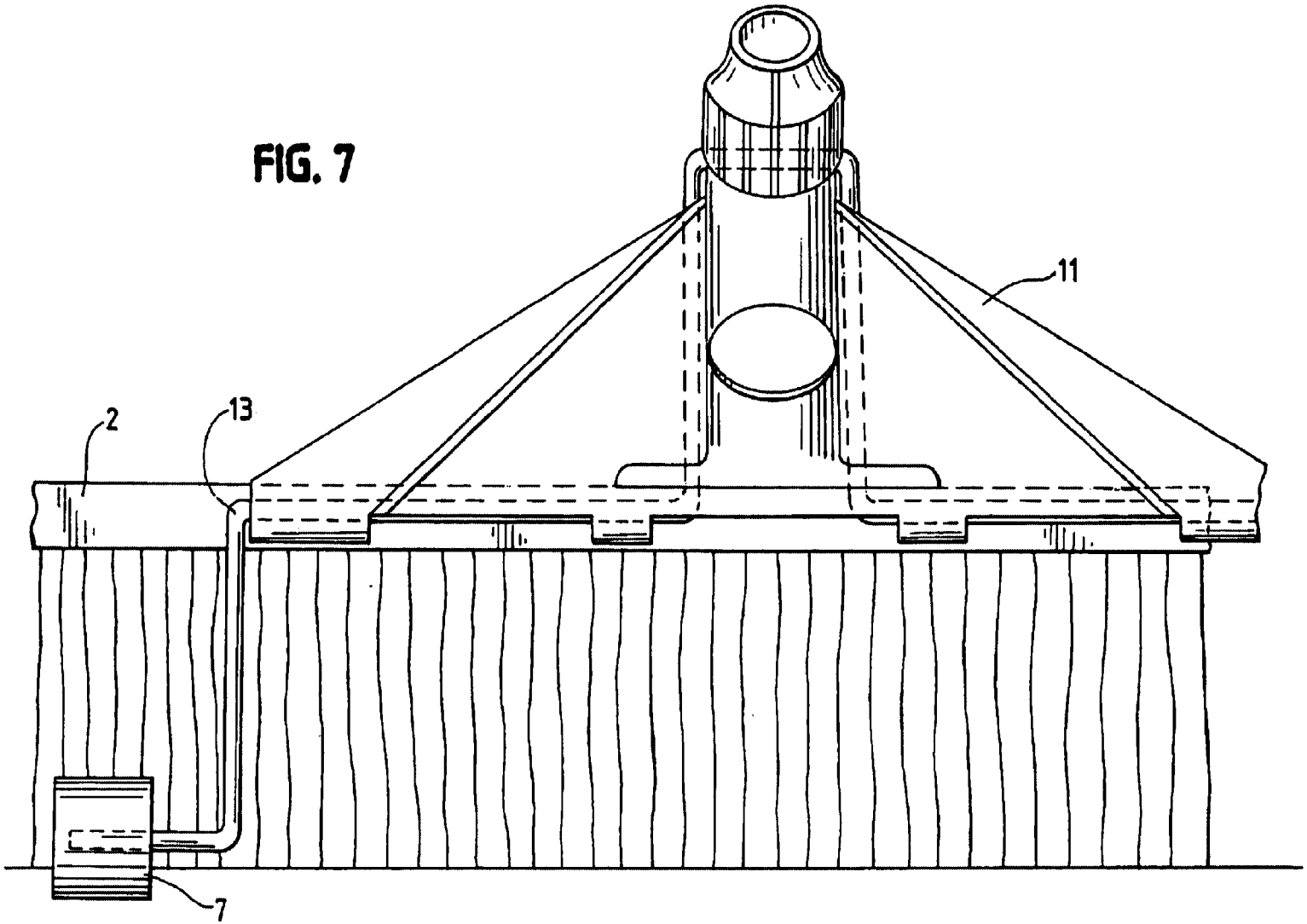

FIG. 7: Shows a partial rear view of the support means secured to a broom.

Figure 8:
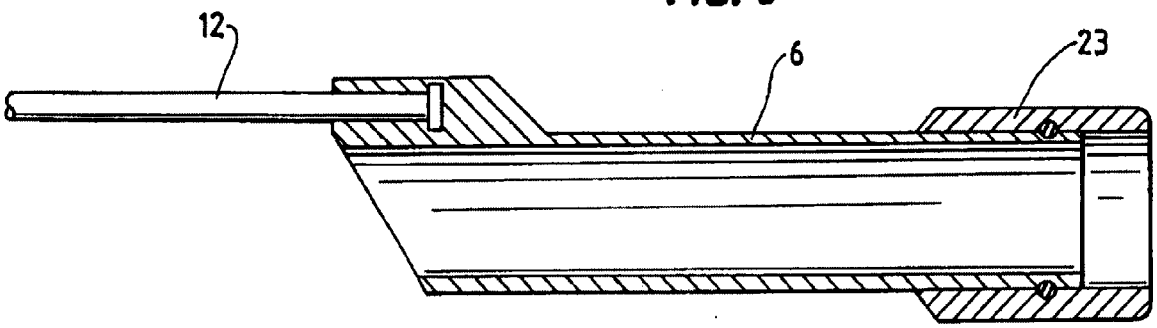

FIG. 8: Shows a cross-sectional view of the actuating sleeve.

Figure 9A:
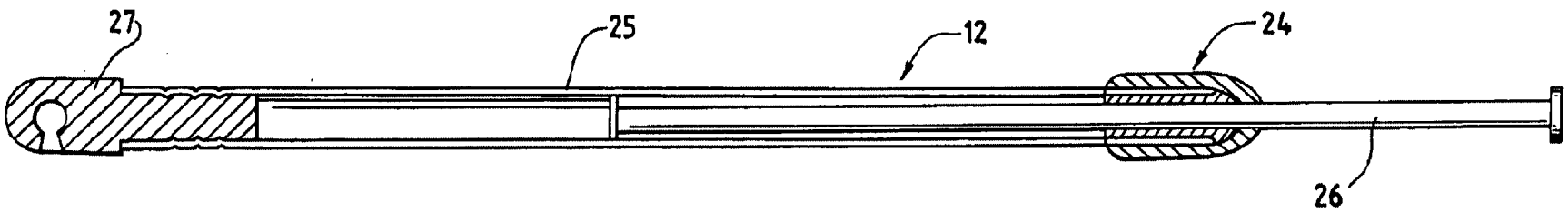
Figure 9B:
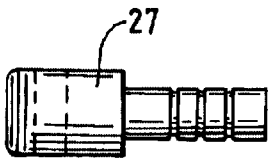

FIG. 9: Shows a cross-sectional view of the adjustable linkage.

FIG. 10: Shows a perspective view of an alternative embodiment of a sweeping device.

FIG. 11: Shows a side view and an end perspective view of the linkage of FIG. 10.

DETAILED DESCRIPTION OF DRAWINGS

Referring to FIG. 1 there is shown a sweeping device 1 comprising a surface contacting means 2, such as a broom head, and a handle 3. A framework 4 in the form of a bent steel or plastics rod is pivotally mounted to surface contacting means 2 via fixtures 8. The fixtures 8 can be integrally moulded into a plastic broom stock or attached to an existing broom, for example if the broom stock is wooden. The friction reducing means are wheels 7 provided on arms at either end of the framework 4.

As best shown in FIG. 3, a U shaped portion of framework 4 indicated by indicia 9 passes through an aperture in the end of shaft 5. The other end of shaft 5 is connected to sleeve 6 which is slidable along handle 3. Movement of sleeve 6 towards broom head 2 causes framework 4 to rotate so as to raise wheels 7. Movement of sleeve 6 away from broom head 2 causes framework 4 to rotate so as to lower wheels 7.

Although in this embodiment the surface contacting means 2 is seen to be provided with the plurality of bristles it is to be appreciated that the invention is applicable to devices incorporating other surface contacting means such as sponges, scrapers etc. The framework 4 having arms extending to the wheels 7 may be adapted so that the height of the surface contacting means 2 above the ground surface can be adjusted relative to the friction reducing means by providing adjustable extensions on the arms of framework 4. Accordingly the friction reducing means can be employed on brooms having different lengths of bristles.

In use the sweeping device 1 may be held by sleeve 6 so that when the broom is pushed forward wheels 7 are raised to the position shown in FIG. 1 so that the surface contacting means 2 contacts the surface to be cleaned. On the backwards-stroke the backward movement of sleeve 6 causes framework 4 to rotate and place wheels 7 in the lowered position shown in FIG. 2. In this position the wheels carry the weight of the surface contacting means 2 for the backwards stroke. It also facilitates easy sidewards movement of the surface contacting means 2.

The device may be configured so that the surface contacting means 2 contacts the surface to be cleaned during the backwards stroke with the surface contacting means 2 being supported by the wheels on the forward stroke. To achieve this the U section shown in area 9 is positioned on the other side of handle 3 (ie. U section 9 passes underneath handle 3). In this configuration the wheels are forced down to the in use position shown in FIG. 2 when sleeve 6 is pushed towards broom head 2. When sleeve 6 is pulled away from broom head 2 the wheels 7 are retracted to the out of use position shown in FIG. 1. On the forward sweep sleeve 6 is pushed towards broom head 2 and so lowers wheels 7 to the in use position shown in FIG. 2 allowing the broom head to be easily moved in the forward direction. For a backward sweep sleeve 6 is moved away from broom head 2 and the wheels are raised to the position shown in FIG. 1 so that the broom contacts the surface to be swept.

Wheels 7 are preferably castor wheels so that the sweeping device may be moved in any desired direction. Wheels 7 may be replaced by other friction reducing means such as rollers where, for example, asphalt or concrete is being laid and levelled out. Alternatively, wheels 7 may be replaced by skids, depending upon the surface which is to be swept or scraped.

The above described embodiment is preferred, however an alternative embodiment will now be described.

Referring to FIGS. 4 to 7 there is shown a support means 10 secured to a broom comprising a broom head 2 and a handle 3. The support means 10 consists of a body portion 11, an actuating sleeve 6, a linkage 12 and friction reducing means in the form of a shaft 13 and wheels 7.

Body portion 11 has a bore 14 formed therein dimensioned to receive the shaft of the broom handle 3. When body 11 is appropriately positioned along the shaft of handle 3 a fastening means secures body portion 11 in place. In this example the fastening means is in the form of a threaded sleeve 15 which is screwed upon a complimentary threaded portion 16 of body 11. A number of slots 17 are cut into the upper end of threaded section 16 defining a number of fingers 18. Threaded sleeve 15 has a ramped portion 19 abutting ramped portion 20 of threaded section 12. As threaded sleeve 15 is rotated clockwise the ramped portions 19 and 20 act to force fingers 18 towards handle 2 to secure body 11 to handle 2. By tightening and untightening the threaded sleeve 15 body 11 may selectively be secured or released from handle 2. In this way body 11 may be moved to a desired point along handle 2 and secured in place by tightening threaded sleeve 15. This enables the support means to be located at the correct position for any broom.

Along a bottom edge of body portion 11 are provided a number of clip sections 21, the shape of which are best shown in cross-section in FIG. 5.

Shaft 13 can be snapped into clips 21 and when located in the position shown in FIG. 5 is pivotable about clips 21. A loop section 22 of shaft 13 extends upwardly above handle 3 and is connected via linkage 12 to actuator 6.

Movement of actuating sleeve 6 along handle 3 towards broom head 2 forces loop 22 forward and rotates wheels 7 upwards. Movement of actuating sleeve 6 away from broom head 2 moves loop 22 backwards and causes wheels 7 to rotate downwardly to the position shown in FIGS. 4 to 8.

The actuating sleeve is shown in cross section in FIG. 8. Actuating sleeve 6 is connected at one end to linkage 12 and at the other end has a sleeve 23 which is rotatable relative to actuating sleeve if it is desired to lock actuating sleeve 6 with respect to handle 3.

FIG. 9 shows adjustable linkage 12 in cross section. Linkage 12 is seen to include a locking mechanism 24, similar to the one provided on body portion 11, to enable adjustment of shaft sections 25 and 26 to set linkage 12 to a desired length. End 27 is designed to clip lock onto loop 22.

In use, a user holds onto actuating sleeve 6 so that when the broom is pushed forward loop 22 is forced towards broom head 2 via linkage 12. This raises wheels 7 and enables the broom head 2 to sweep the floor. When a user pulls backwards on actuating sleeve 6 loop 22 is rotated away from broom head 2 and lowers wheels 7 to the position shown in FIG. 5. The broom head may be lifted clear of the floor and supported by the support means so that the broom may be easily moved without undue effort.

It will also be appreciated that alternative locking devices may be used to secure the support means to a shaft or that the support means may be integrally formed with a shaft. Further, linkage 12 may be of a predetermined length when the support means is designed for a particular type of broom. Furthermore the linkage 12 may be adjustable in length to suit a range of heights of users. The adjustment may be provided by telescopic means or other known extension means.

FIGS. 10 and 11 show a further embodiment of a sweeping device. The embodiment illustrated in FIGS. 10 and 11 has an inverted "U" shaped linkage 28 between actuating sleeve 6 and loop 22.

A stopping means 29 is also optionally located on the linkage 28. The stopping means 29 is adapted to abut against a stopper 30 located on body portion 11 when the actuating sleeve is pushed to its required maximum extent down the handle 3 towards broom head 2.

Additionally, the stopper 30 on body portion 11 is adapted to act as a stopping means when the sleeve 6 is pulled to its required maximum extent up handle 3 away from broom head 2, until either loop 22 or linkage 28 abuts the stopper 30.

Linkage 28 is connected to loop 22 by a clip 31 which is adapted to lock onto loop 22 as illustrated in FIG. 11.

Additionally, in FIG. 10 a locking means 32 on the actuating sleeve 6 can be employed if it is envisaged that one needs to lock the movement of the actuating sleeve relative to handle 3. Such a lock can be, for example a cam lever which bites onto handle 3 through an orifice 33 in the actuating sleeve 6.

Further, it will be appreciated that the invention may be used with a variety of other implements, such as mops, and a broom is described herein purely by way of example. The support means may be sold as a separate unit or attached to a broom etc or be integrally formed therewith. Furthermore, the support means may be connected to the surface contacting means by fixtures similar to that illustrated in FIG. 1.

Sweeping devices incorporating the friction reducing means of the invention may be sold in combination or the friction reducing means and actuating means may be sold separately as a kit enabling existing sweeping devices to be modified to include the device of the invention.

The construction materials of the device of the invention can include plastics, aluminium, steel or fibreglass.

It will be appreciated that the actuating mechanism in the form of the actuating sleeve 6 and shaft 5 shown in FIGS. 1 to 3 or actuating sleeve 6 and linkage 12 in FIGS. 4 to 9 or actuating sleeve 6 and linkage 28 in FIGS. 10 and 11 may be replaced by other actuating means, such as a solenoid actuated by an electrical switch or a hydraulic or pneumatic arrangement.

It will be appreciated that the friction reducing means such as wheels 7 may be located at the front, back, rear or sides of the broom. However, location of the wheels at the rear of the broom is particularly preferred due to its ease of operation and due to the fact that it avoids the wheels engaging upright surfaces.

It will also be appreciated that a combination of features of the described embodiments could be selected to produce further alternative embodiments.

The invention provides a sweeping device which significantly reduces the effort required in sweeping. The invention is of particular benefit where large industrial size sweeping devices are used.

It is envisaged that the sweeping device of the invention may be employed for a number of different purposes. It is envisaged, for example, that the device may be employed to sweep water from cricket fields. Such a device would assist in reducing the effort required for such a task.

Where in the foregoing description reference has been made to integers and elements having known equivalents, then such equivalents are incorporated as if individually set forth.

Although this invention has been described by way of example and with reference to possible embodiments thereof, it is to be understood that modifications and improvements may be made without departing from the scope of the invention.

What we claim is:

1. A sweeping device having an actuating means, the sweeping device including a surface contacting means, a handle connected to the surface contacting means and a friction reducing means, in which the friction reducing means is adapted to enable the lifting of the surface contacting means of the sweeping device from the surface being swept or scraped upon user actuation of the actuating means, in which the actuating means is a sleeve located on the handle of the sweeping device.

2. A sweeping device according to claim 1, in which the friction reducing means is adapted to substantially, reduce the effort of a forward and/or reverse and/or a sideways stroke of the sweeping device.

3. A sweeping device according to claim 1 or claim 2 in which the friction reducing means is located on the surface contacting means of the sweeping device.

4. A sweeping device according to claim 1 in which the actuating means is moveable along the handle of the sweeping device in a forward or backward direction relative to the surface contacting means.

5. A sweeping device according to claim 4 in which the actuating means further includes a lock means to lock the actuating means on the handle of the sweeping device.

6. A sweeping device according to claim 1 in which the friction reducing means are wheels provided on arms extending from the surface contacting means.

7. A sweeping device according to claim 6 in which the arms are adjustable in length to provide a range of elevations of the surface contacting means relative to the friction reducing means.

8. A sweeping device according to claim 6 or claim 7 including a shaft having the arms extending from either and to support the wheels, the actuating means being adapted to pivot the shaft to rotate the wheels downwardly towards the contacting means of the sweeping device or upwardly away from the contacting means of the sweeping device.

9. A sweeping device according to claim 8 in which the shaft is linked to the actuating means by an adjustable linkage.

10. A sweeping device having an actuating means and a surface contacting means, including a support member comprising a body portion securable to a handle or a stock of the sweeping device and friction reducing means extending from the body portion of the support means which, when the support means is secured to a sweeping device, can selectively be brought into contact with a surface to at least partially support the head of a sweeping device, by user actuation of the actuating means, in which the actuating means is a sleeve located on the handle of the sweeping device.

11. A sweeping device a according to claim 10 in which the actuating means is adapted to adjust the position of the friction reducing means upon actuation to facilitate support of the sweeping device by the friction reducing means.

12. A sweeping device according to claim 10 or claim 11 in which the friction reducing means is preferably one or more wheels provided on arms extending from either side of the body portion.

13. A sweeping device according to claim 10 in which the body portion is secured to the handle of the sweeping device by a fastening means which allows securement of the body portion at a selected location along the handle of the sweeping device.

14. A sweeping device a according to claim 13 in which the fastening means of the body portion of the sweeping device includes a threaded sleeve which may be screwed onto part of the body to cause portions of the body to be forced towards the handle of the sweeping device to retain the body portion on the handle of the sweeping device.

15. A sweeping device according to claim 10 in which the friction reducing means includes a shaft having arms extending from either end to support the wheels, the actuating means being adapted to pivot the shaft to rotate the wheels downwardly towards the contacting means of the sweeping device or upwardly away from the contacting means of the sweeping device.

16. A sweeping device according to claim 10 in which the actuating sleeve is linked to the shaft by an adjustable linkage.

17. A sweeping device according to claim 16 in which the actuating means further includes a lock means to lock the actuating means on the handle of the sweeping device.

18. A kit adapted to enable the modification of a traditional sweeping device to incorporate a friction reducing means, including a friction reducing means adapted for fixation to a sweeping device and an actuating means comprising a sleeve located on the handle of the sweeping device to enable the lifting of the surface contacting means of the sweeping device from the surface being swept or scraped.

19. A method of substantially reducing the effort involved in employing a sweeping device according to claim 1 or claim 10, the method comprising employing the friction reducing means when making a forward and/or reverse and/or a sideways stroke of the sweeping device, including a step in which the friction reducing means is actuated into position by the actuating means.

* * * * *